US010566710B2

(12) United States Patent
Lee et al.

(10) Patent No.: US 10,566,710 B2
(45) Date of Patent: Feb. 18, 2020

(54) COAXIAL CABLE CONNECTOR

(71) Applicant: GIGALANE CO., LTD., Hwaseong-si, Gyeonggi-do (KR)

(72) Inventors: Jin Uk Lee, Hwaseong-si (KR); Sang Min Seo, Hwaseong-si (KR); Jang Mook Lee, Hwaseong-si (KR); Sun Tae Kim, Hwaseong-si (KR); Hwang Sub Koo, Hwaseong-si (KR); Hyun Je Kim, Hwaseong-si (KR); Hee Seok Jung, Hwaseong-si (KR)

(73) Assignee: GIGALANE CO., LTD., Hwaseong-si, Gyeonggi-Do (KR)

( * ) Notice: Subject to any disclaimer, the term of this patent is extended or adjusted under 35 U.S.C. 154(b) by 0 days.

(21) Appl. No.: 16/097,339

(22) PCT Filed: Apr. 10, 2017

(86) PCT No.: PCT/KR2017/003852
§ 371 (c)(1),
(2) Date: Oct. 29, 2018

(87) PCT Pub. No.: WO2017/191906
PCT Pub. Date: Nov. 9, 2017

(65) Prior Publication Data

US 2019/0140371 A1 May 9, 2019

(30) Foreign Application Priority Data

May 4, 2016 (KR) ..... 10-2016-0055311

(51) Int. Cl.
*H01R 9/05* (2006.01)
*H01R 24/38* (2011.01)
(Continued)

(52) U.S. Cl.
CPC ..... *H01R 9/05* (2013.01); *H01R 24/38* (2013.01); *H01R 4/184* (2013.01); *H01R 2103/00* (2013.01)

(58) Field of Classification Search
CPC ..... H01R 9/05; H01R 9/0518; H01R 13/415; H01R 24/38; H01R 4/184
See application file for complete search history.

(56) References Cited

U.S. PATENT DOCUMENTS 6,997,745 B2 * 2/2006 Ikeda ..... H01R 24/40 439/582
7,540,774 B1 * 6/2009 Hung ..... H01R 9/0518 439/582
(Continued)

FOREIGN PATENT DOCUMENTS

CN 201478475 U 5/2010
CN 204289891 U 4/2015
(Continued)

OTHER PUBLICATIONS

International Search Report and Written Opinion of PCT/KR2017/003852 dated May 31, 2017, 10 pages.

*Primary Examiner* — Oscar C Jimenez
(74) *Attorney, Agent, or Firm* — Brundidge & Stanger, P.C.

(57) ABSTRACT

Disclosed is a coaxial cable connector which can be manufactured in an ultra-thin type. The coaxial cable connector of the present invention comprises: a signal pin; a dielectric coupled to the signal pin; a first body coupled to a connector electrically connected to one side of the signal pin; and a second body extending from the first body and coupled to a cable electrically connected to the other side of the signal pin, wherein the second body includes a fixing portion for
(Continued)

fixing the dielectric, and the dielectric includes a to-be-fixed portion corresponding to the fixing portion.

19 Claims, 7 Drawing Sheets

(51) Int. Cl.
*H01R 4/18* (2006.01)
*H01R 103/00* (2006.01)

(56) References Cited

U.S. PATENT DOCUMENTS 10,038,261 B2 * 7/2018 Hashimoto ..... H01R 13/447
2008/0096420 A1 * 4/2008 Zeng ..... H01R 9/0518 439/582
2010/0062639 A1 * 3/2010 Kohnishi ..... H01R 9/0518 439/582
2010/0068927 A1 * 3/2010 Ho ..... H01R 9/0518 439/582
2010/0087091 A1 * 4/2010 Chen ..... H01R 4/48 439/578
2010/0151729 A1 * 6/2010 Chen ..... H01R 9/0518 439/585
2010/0304609 A1 * 12/2010 Lee ..... H01R 13/112 439/585
2012/0094533 A1 * 4/2012 Chen ..... H01R 9/0518 439/578
2012/0164879 A1 * 6/2012 Chiu ..... H01R 4/184 439/578
2012/0322304 A1 * 12/2012 Taguchi ..... H01R 13/501 439/582
2012/0329319 A1 * 12/2012 Zhao ..... H01R 9/0524 439/578
2013/0149897 A1 * 6/2013 Takano ..... H01R 12/718 439/582
2013/0196540 A1 * 8/2013 Sasaki ..... H01R 24/38 439/582
2013/0280948 A1 * 10/2013 Tsuchida ..... H01R 13/62 439/372
2018/0069335 A1 * 3/2018 Hashimoto ..... H01R 9/0518

FOREIGN PATENT DOCUMENTS

JP 3191788 U 6/2014
JP 2015015175 A 1/2015
KR 1020100006015 A 1/2010
KR 1020110120549 A 11/2011

* cited by examiner

[Fig. 1]
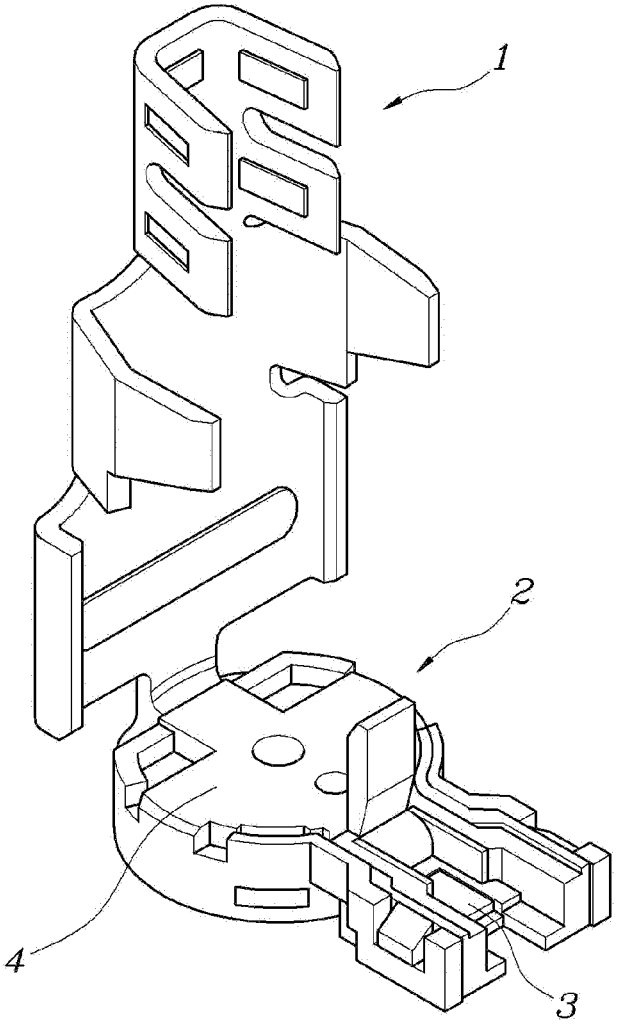
PRIOR ART

[Fig. 2]
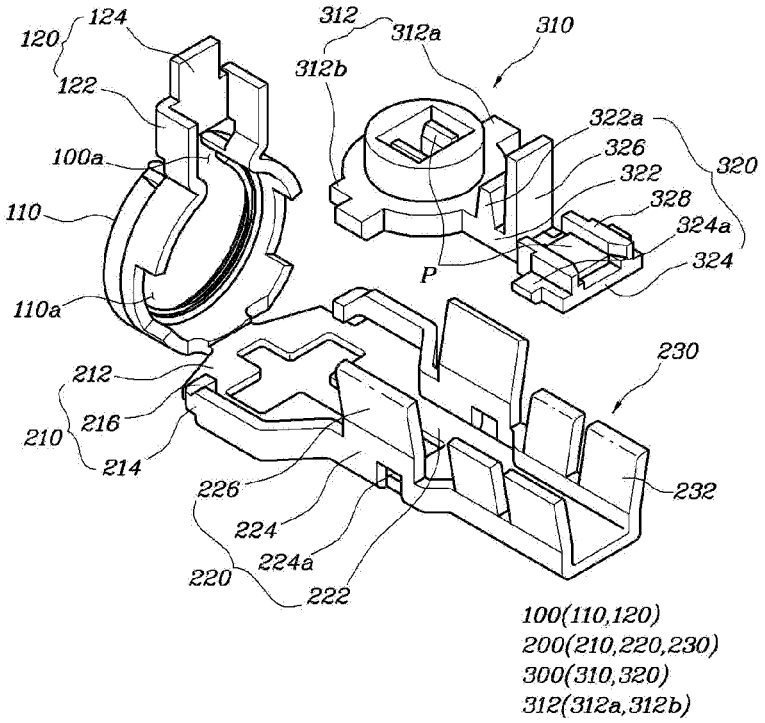

[Fig. 3]
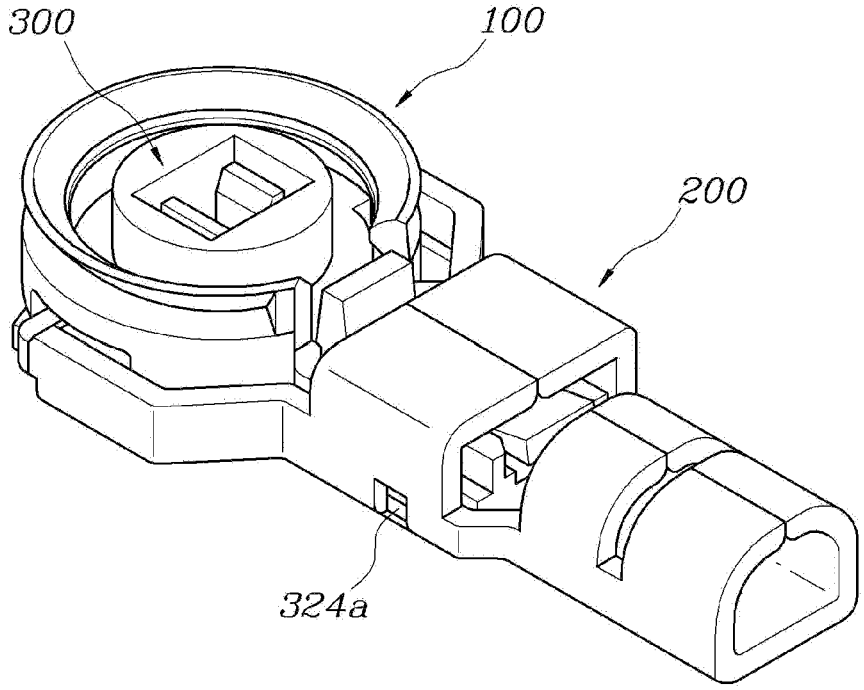
[Fig. 4]
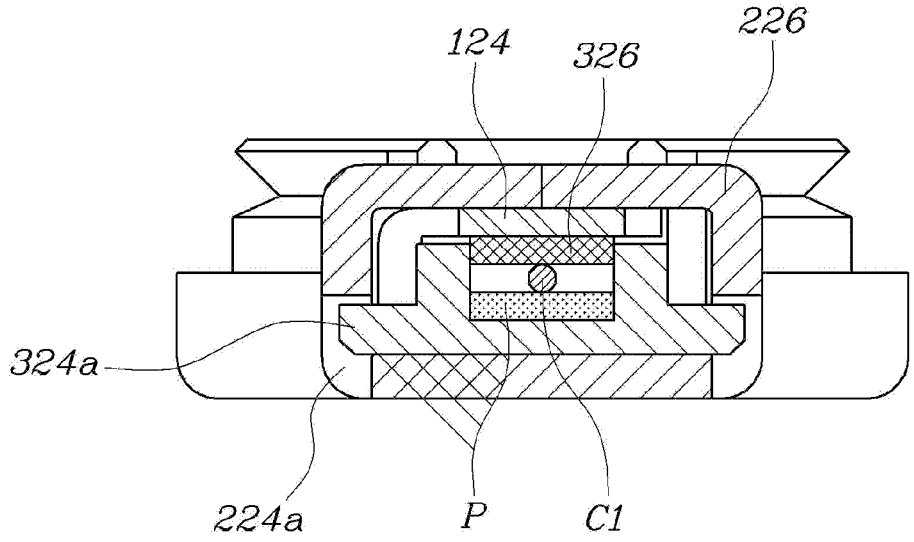

[Fig. 5A]
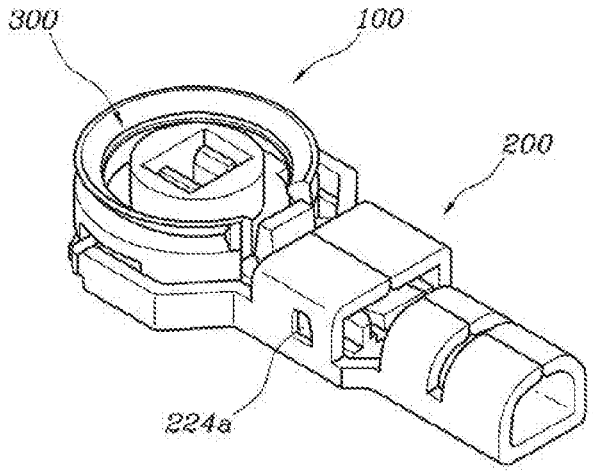
[Fig. 5B]
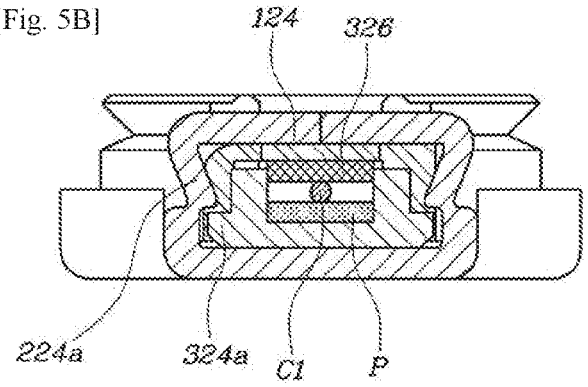

[Fig. 6]
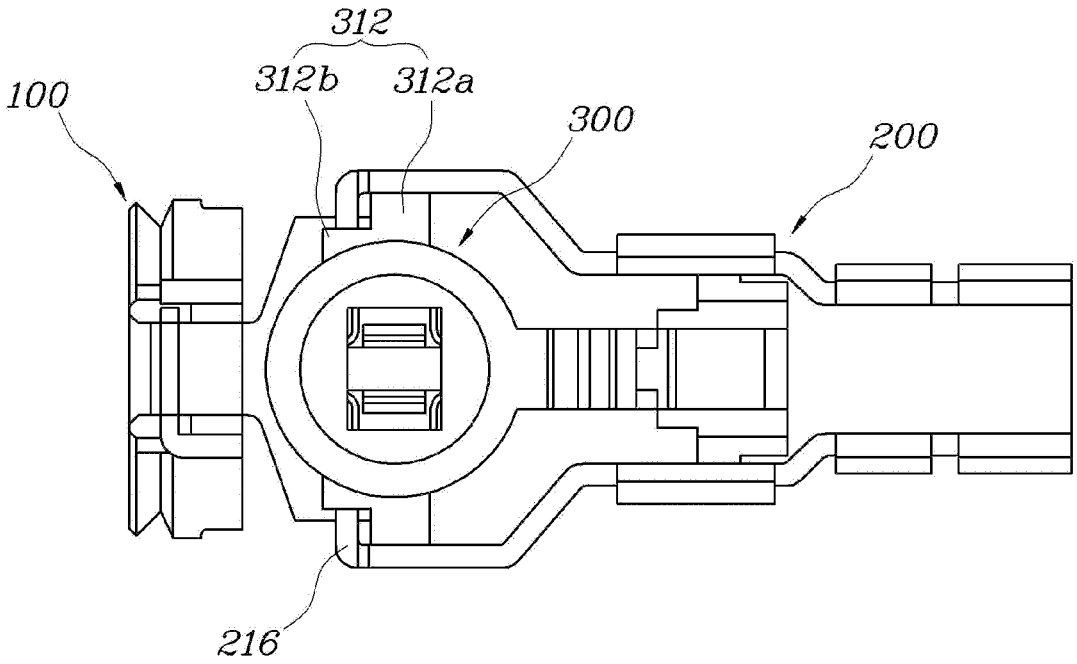

[Fig. 7A]
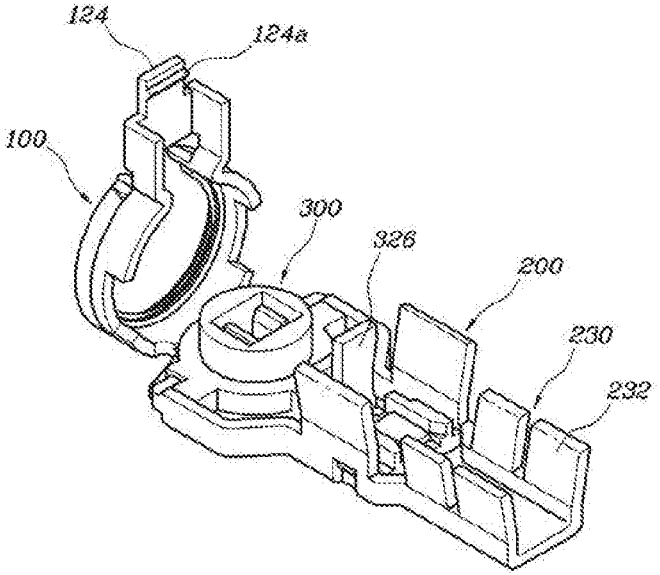
[Fig. 7B]
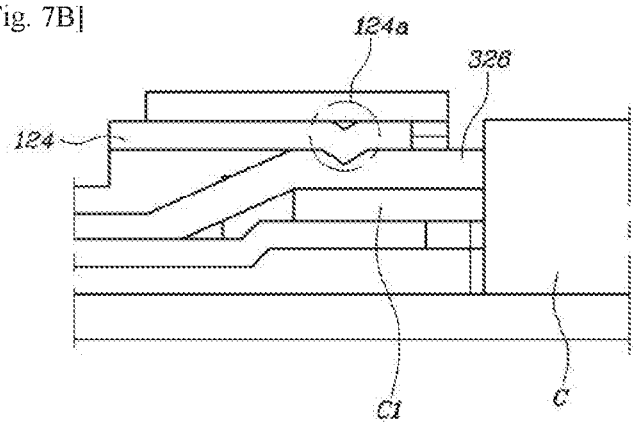

[Fig. 8A]
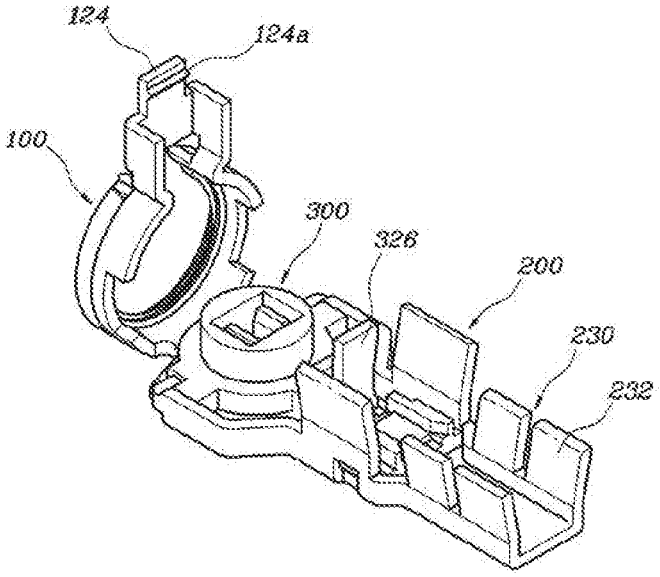
[Fig. 8B]
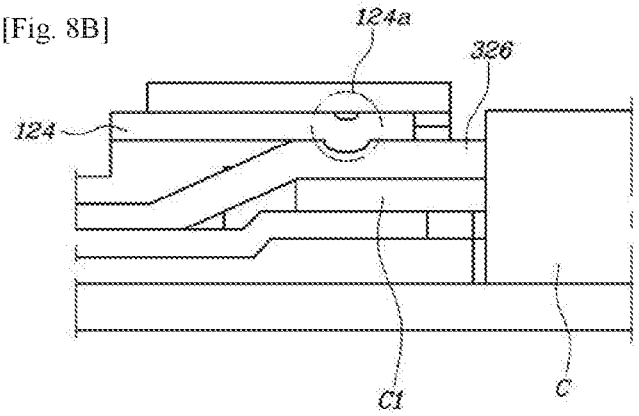

COAXIAL CABLE CONNECTOR

CROSS-REFERENCE TO RELATED APPLICATIONS

This Application is the National Stage filing under 35 U.S.C. § 371 of PCT Application Ser. No. PCT/KR2017/003852 filed on Apr. 10, 2017, which claims the benefit of Korean Patent Application No. 10-2016-0055311 filed on May 4, 2016. The disclosures of both applications are hereby incorporated herein by reference in their entireties.

TECHNICAL FIELD

The present invention relates to a coaxial cable connector.

BACKGROUND

As shown in FIG. 1, a conventional coaxial cable connector includes a cable coupling body 1, a connector coupling body 2, and a dielectric 4 to which a connection conductor 3 is coupled.

The dielectric 4, to which the connection conductor 3 is coupled, is mounted on the connector coupling body 2, and the cable coupling body 1 is folded and coupled to the connector coupling body 2, thereby completing the coaxial cable connector.

The present applicant has recognized various problems of the above-described conventional coaxial cable connector and has conceived and embodied the present invention. The conventional cable connector has the following problems.

First, in the conventional coaxial cable connector, since a fixing portion for fixing the dielectric 4 is formed in the connector coupling body 2, a height of the connector coupling body 2 is increased, and thus a height of the coaxial cable connector is inevitably increased. Accordingly, it is difficult to implement the coaxial cable connector as an ultra-thin type.

Second, in the conventional coaxial cable connector, a fixing force with respect to the dielectric 4 is weak.

Third, since a central conductor of the coaxial cable is exposed to the outside, it can be affected by an external signal.

Fourth, when the dielectric 4 is mounted on the connector coupling body 2 or the cable coupling body 1 is folded and coupled to the connector coupling body 2, coupling precision is low. Thus, defective products are generated.

The foregoing is intended merely to aid in the understanding of the background of the present invention and is not intended to mean that the present invention falls within the purview of the related art that is already known to those skilled in the art.

Technical Problem

The present invention is directed to providing a coaxial cable connector capable of being manufactured as an ultra-thin type, improving a coupling force, being shielded from an external signal, and improving coupling precision thereof.

Technical Solution

One aspect of the present invention provides a coaxial cable connector including: a signal pin; a dielectric to which the signal pin is coupled; a first body coupled to a connector electrically connected to one side of the signal pin; and a second body formed to extend from the first body and coupled to a cable electrically connected to the other side of the signal pin, wherein the second body includes a fixing portion configured to fix the dielectric, and the dielectric includes a fixed portion corresponding to the fixing portion.

The first body may include a first body portion formed in a ring shape of which the other side is open, and a first extension portion formed to extend from the other side of the first body portion, the second body may include a second body portion corresponding to the first body portion and a second extension portion formed to extend from the other side of the second body portion and corresponding to the first extension portion, and the dielectric may include a third body portion formed to correspond to the first body portion and the second body portion and accommodated in a space formed by the first body portion and the second body portion and a third extension portion formed to correspond to the first extension portion and the second extension portion and formed to extend from the third body portion.

The third extension portion may include a connection bracket formed to protrude from an outer circumferential surface of the third body portion, a third bracket formed to extend from the connection bracket and configured to support the other side of the signal pin, and a cover folded toward the other side of the signal pin from the connection bracket and formed to extend to be coupled to the third bracket, and the second extension portion may include an extension flat surface portion formed to extend in a lateral direction from the second body portion, a pair of second brackets formed to extend in a vertical direction from both sides of the extension flat surface portion, and a pair of main fixing pieces formed to extend from one ends of the pair of second brackets and configured to press the cover.

The first extension portion may include a first bracket formed to extend from the other side of the first body portion and a tongue portion formed to extend from the first bracket and positioned between the cover and the main fixing pieces to press a flat surface of the cover.

The tongue portion may be positioned between the pair of main fixing pieces facing each other so that an external signal is blocked.

The tongue portion may include a press portion formed in a width direction thereof.

The third bracket may further include a pair of vertical guides formed to extend in a vertical direction from both sides thereof so as to guide the cover to be coupled to the third bracket.

The fixing portion and the fixed portion may be formed in the second extension portion and the third extension portion, respectively.

The second extension portion may include an extension flat surface portion formed to extend in a lateral direction from the second body portion and a pair of second brackets formed to extend in a vertical direction from both sides of the extension flat surface portion, the third extension portion may include a connection bracket formed to protrude from an outer circumferential surface of the third body portion and a third bracket formed to extend from the connection bracket and configured to support the other side of the signal pin, and the fixing portion and the fixed portion may be formed in the second bracket and the third bracket, respectively.

The fixing portion may include a fixing groove, and the fixed portion may include a fixed protrusion.

The fixed portion may include a fixed protrusion, and the fixing portion may include a fixing protrusion formed to protrude toward the fixed protrusion.

The third extension portion may include a connection bracket formed to protrude from an outer circumferential surface of the third body portion, and the first extension portion may include a first bracket formed to extend from the other side of the first body portion, wherein an insertion protrusion is formed to protrude from the connection bracket, and an insertion hole is formed between the first body portion and the first bracket such that the insertion protrusion is inserted thereinto.

One side surface of the insertion protrusion may be formed to be inclined.

The coaxial cable connector may further include a guide protrusion formed on an outer circumferential surface of the third body portion, wherein the second body portion includes a flat surface portion, a vertical flange formed to extend in a vertical direction from each of both sides of the flat surface portion, and a stopper which is bent at one end of the vertical flange toward an inner side of the flat surface portion such that the guide protrusion is hung thereon.

The guide protrusion may include a first guide protrusion configured to restrict the dielectric from moving in one side direction of the second body and a second guide protrusion configured to restrict the dielectric from moving in a width direction of the second body.

A guide groove, into which the guide protrusion is inserted, may be formed in a lower end of the first body portion.

Advantageous Effects

The present invention may have various effects as follows.

First, a coaxial cable connector can be manufactured as an ultra-thin type.

Second, a dielectric can be easily coupled.

Third, a fixing force and an electrical connection with respect to a coaxial cable can be improved.

Fourth, an external signal can be blocked.

Fifth, coupling precision can be improved.

BRIEF DESCRIPTION OF DRAWINGS

FIG. 1 is a view illustrating a conventional coaxial cable connector.

FIG. 2 is a view illustrating a coaxial cable connector according to the present invention.

FIG. 3 is a view illustrating a coupled state of the coaxial cable connector according to the present invention.

FIG. 4 is a cross-sectional view of FIG. 3.

FIGS. 5A and 5B are views illustrating other examples of fixing portions and fixed portions of the coaxial cable connector according to the present invention.

FIG. 6 is a plan view illustrating the coaxial cable connector according to the present invention.

FIGS. 7A and 7B are views illustrating a press portion of the coaxial cable connector according to the present invention.

FIGS. 8A and 8B are views illustrating another example of a press portion of the coaxial cable connector according to the present invention.

MODE FOR CARRYING OUT THE INVENTION

The objects, specific advantages, and novel features of the present invention will become more apparent from the following detailed description and embodiments in conjunction with the accompanying drawings. It should be noted that reference numerals are added to the elements of the drawings in the present specification with the same numerals when possible, even if the reference numerals are on other drawings. Also, the terms "first," "second," etc. may be used to describe various elements, but the elements should not be limited to the terms. The terms are used only for the purpose of distinguishing one element from another. In the following description of the invention, a detailed description of publicly-known related arts will be omitted when it is determined that the spirit or gist of the invention may be unnecessarily obscured.

As shown in FIGS. 2 to 4, a coaxial cable connector of the present invention includes a signal pin P, a dielectric 300, a first body 100, and a second body 200.

The first body 100 is coupled to a connector, and the second body 200 is coupled to a cable C (see FIGS. 7B and 8B).

The first body 100 and the second body 200 are coupled to each other to form a space in which the dielectric 300 is to be accommodated.

The signal pin P is connected to the dielectric 300. One side of the signal pin P is electrically connected to the connector, and the other side of the signal pin P is electrically connected to the cable C (see FIGS. 7B and 8B).

Fixing portions 224*a* for fixing the dielectric are formed in the second body 200. Fixed portions 324*a* corresponding to the fixing portions 224*a* are formed in the dielectric 300.

The coaxial cable connector of the present invention is manufactured by mounting the dielectric 300 on the second body 200, coupling and fixing the fixing portions 224*a* to the fixed portions 324*a*, and then folding the first body 100 to be coupled to the second body 200. Since the fixing portions 224*a* are formed in the second body 200 to which the cable C (see FIGS. 7B and 8B) is coupled and the fixed portions 324*a* are formed in the dielectric 300 to fix the dielectric 300 to the second body 200, a height of the first body 100, in particular, a height of a first body portion 110, may be reduced, thereby implementing the coaxial cable connector as an ultra-thin type.

The first body 100 may include the first body portion 110 and a first extension portion 120. The second body 200 may include a second body portion 210 and a second extension portion 220. The dielectric 300 may include a third body portion 310 and a third extension portion 320.

One side of the first body portion 110 and one side of the second body portion 210 are connected to be foldable.

In addition, the first body portion 110 may be formed in a ring shape of which the other side is open. The first extension portion 120 may be formed to extend in an outward direction from the opened other side of the first body portion 110. A shape of the first body portion 110 may be modified into various shapes other than the ring shape according to a designer's intention.

The second body portion 210 is formed in a shape corresponding to the first body portion 110 to form a space together with the first body portion 110, wherein the space is capable of accommodating the third body portion 310 of the dielectric 300. When the first body 100 and the second body 200 are coupled, the second body portion 210 is coupled to the first body portion 110.

The second extension portion 220 is formed to extend from the other side of the second body portion 210 and is formed to correspond to the first extension portion 120 described above. That is, the second extension portion 220 and the first extension portion 120 form a space capable of accommodating the third extension portion 320 of the dielectric 300.

The dielectric 300 includes the third body portion 310 and the third extension portion 320 formed to extend from the third body portion 310 so as to correspond to the first extension portion 120 and the second extension portion 220.

As described above, the third body portion 310 is accommodated in an inner space formed when the first body portion 110 and the second body portion 210 are coupled. The third extension portion 320 is accommodated in an inner space formed by the first extension portion 120 and the second extension portion 220.

The third body portion 310 may be formed in a substantially circular shape so as to be inserted into the first body portion 110, and a shape thereof may be variously changed according to a change in shape of the first body portion 110.

Meanwhile, the third extension portion 320 may include a connection bracket 322, a third bracket 324, and a cover 326. The second extension portion 220 may include an extension flat surface portion 222, second brackets 224, and main fixing pieces 226.

The connection bracket 322 is formed to protrude from an outer circumferential surface of the third body portion 310. The third bracket 324 is formed to extend from the connection bracket 322 and supports the other side of the signal pin P. One end of the cover 326 is coupled to the connection bracket 322 such that the cover 326 is folded toward the other side of the signal pin P so as to be coupled to the third bracket 324. That is, the connection bracket 322 is an element which is placed in the inner space formed by the first extension portion 120 and the second extension portion 220. The other side of the signal pin P is supported on the third bracket 324 formed to extend from the connection bracket 322. One end of the cover 326 is coupled to an upper portion of the connection bracket 322 such that the cover 326 is folded toward the third bracket 324.

The extension flat surface portion 222 of the second extension portion 220 is formed to extend in a lateral direction from the second body portion 210.

The second bracket 224 is formed to extend in a vertical direction from each of both sides of the extension flat surface portion 222. A pair of second brackets 334 are installed with respect to the extension flat surface portions 222. The main fixing piece 226 is formed to extend from one end of each of the second brackets 224.

Since the main fixing pieces 226 are folded to directly press a flat surface of the cover 326 in a folded state, a fixing force and an electrical connection with respect to the coaxial cable may be improved as compared to when a conventional coaxial cable connector presses a dielectric to indirectly press a cover.

On the other hand, the first extension portion 120 may include a first bracket 122 formed to extend from the other side of the first body portion 110 and a tongue portion 124 formed to extend from the first bracket 122.

In a state in which the first body 100, the second body 200, and the dielectric 300 are coupled last, the tongue portion 124 is positioned between the cover 326 and the main fixing pieces 226 and functions to press the flat surface of the cover 326.

In addition, the tongue portion 124 is preferably positioned between a pair of main fixing pieces 226 which face each other in a final coupling state so that an external signal is blocked.

As described above, according to the coaxial cable connector of the present invention, the main fixing pieces 226 may press the tongue portion 124 and the tongue portion 124 may press the cover, thereby more strongly fixing the cable C (see FIGS. 7B and 8B) and the dielectric 300. In addition, the tongue portion 124 may be positioned to correspond to a fine gap formed between the pair of main fixing pieces, and thus, an external signal introduced through the fine gap can be blocked.

The coaxial cable connector of the present invention may further include a pair of vertical guides 328 formed to extend in a vertical direction from both sides of the third bracket 324 such that the cover 326 is coupled to an accurate position of the third bracket 324.

The pair of vertical guides 328 are formed to extend in the vertical direction from both sides of the third bracket 324 supporting the other side of the signal pin P. Thus, the pair of vertical guides 328 form a space capable of accommodating the signal pin P and also function to guide the cover 326 when the cover 326 is folded toward the other side of the signal pin P.

Meanwhile, as shown in FIGS. 2 to 4, the fixing portions 224*a* and the fixed portions 324*a* of the coaxial cable connector of the present invention are formed in the second extension portion 220 and the third extension portion 320 described above, respectively.

The fixing portions 224*a* may be formed in the second brackets 224 of the second extension portion 220. The fixed portions 324*a* may be formed in the third bracket 324 of the third extension portion 320.

In addition, the fixing portion 224*a* may include a fixing groove 224*a*, and the fixed portion 324*a* may include a fixed protrusion 324*a*. Shapes and positions of the fixing portion 224*a* and the fixed portion 324*a* may be variously changed according to a designer's intention.

As shown in FIGS. 5A and 5B, the fixed portion 324*a* may include a fixed protrusion 324*a*, and the fixing portion 224*a* may include a fixing protrusion 224*a* formed to protrude toward the fixed protrusion 324*a*.

As described above, since the dielectric 300 is fixed to the second body 200 through the fixing portions 224*a* and the fixed portions 324*a*, the height of the first body 100, in particular, the height of the first body portion 110, may be reduced, thereby implementing the coaxial cable connector as an ultra-thin type, and further, thereby strongly fixing the dielectric 300 to the second body 200.

As shown in FIG. 2, the third extension portion 320 of the coaxial cable connector of the present invention may include the connection bracket 322 formed to protrude from the outer circumferential surface of the third body portion 310, and the first extension portion 120 may include the first bracket 122 formed to extend from the other side of the first body portion 110. Thus, it is preferable that an insertion protrusion 322*a* is formed to protrude from a flat surface of the connection bracket 322 and an insertion hole 100*a* is formed between the first body portion 110 and the first bracket 122 such that the insertion protrusion 322*a* may be inserted thereinto.

As described above, when the first body 100 is folded and coupled to the second body on which the dielectric 300 is mounted, the insertion protrusion 322*a* is inserted into the insertion hole 100*a* formed between the first body portion 110 and the first bracket 122. Thus, the insertion protrusion 322*a* and the insertion hole 100*a* improve coupling precision between the first body 100 and the second body 200.

In addition, one side surface of the above-described insertion protrusion 322*a* may be formed to be inclined.

As described above, since one side surface of the insertion protrusion 322*a* is inclined such that a distance between a lower end thereof and a lower end of the cover 326 is less than a distance between an upper end thereof and an upper end of the cover 326 in a state in which the cover 326 is vertically erected, although the insertion protrusion 322*a* is not properly inserted into the insertion hole 100*a*, when one end of the insertion protrusion 322*a* is inserted into the insertion hole 100*a*, the inclined one surface of the insertion protrusion 332*a* may be properly inserted into the insertion hole 100*a* along one side surface of the tongue portion 124 forming the insertion hole 100*a*.

As shown in FIGS. 2 and 6, the coaxial cable connector of the present invention may further include guide protrusions 312 formed on the outer circumferential surface of the third body portion 310. In addition, the second body portion 210 includes a flat surface portion 212, vertical flanges 214 formed to extend in a vertical direction from both sides of the flat surface portion 212, and stoppers 216 bent at one ends of the vertical flanges 214 toward an inner side of the flat surface portion 212 such that the guide protrusions 312 are hung thereon.

As described above, the guide protrusion 312 is hung on the stopper 216, thereby restricting the dielectric 300 coupled to the second body 200 from moving.

In addition, the guide protrusions 312 may include a first guide protrusion 312*a* configured to restrict the dielectric 300 from moving in one side direction of the second body 200 and a second guide protrusion 312*b* configured to restrict the dielectric 300 from moving in a width direction of the second body 200.

Furthermore, guide grooves 110*a*, into which the guide protrusions 312 are inserted, may be formed in a lower end of the first body portion 110.

As described above, when the first body 100 is folded and coupled to the second body on which the dielectric 300 is mounted, the guide protrusions 312 are inserted into the guide grooves 110*a*. Accordingly, the guide protrusions 312 and the guide grooves 110*a* improve coupling precision between the first body 100 and the second body 200.

On the other hand, as shown in FIGS. 7A and 7B, a press portion 124*a* may be formed in the tongue portion 124 of the coaxial cable connector of the present invention in a width direction of the tongue portion 124.

The press portion 124*a* is formed to protrude from a lower surface of the tongue portion 124 to press the flat surface of the cover 326. The press portion 124*a* may be formed to have a triangular-shaped cross section. Alternatively, as shown in FIGS. 8A and 8B, the press portion 124*a* may be formed to have an arch-shaped cross section. A shape of the press portion 124*a* may be variously modified according to a designer's intention.

The press portion 124*a* increases a pressurizing force of a portion of the flat surface of the cover 326, which is positioned on a central conductor C1 of the coaxial cable, thereby improving a fixing force and an electrical connection with respect to the central conductor C1 of the cable C (see FIGS. 7B and 8B).

The coaxial cable connector of the present invention may further include auxiliary fixing pieces 232 formed separately from the main fixing pieces 226 in order to fix the cable C (see FIGS. 7B and 8B). It is preferable that the auxiliary fixing pieces 232 are formed on an auxiliary extension portion 230 formed to extend from an end of the second extension portion 220. The auxiliary fixing piece 232 may be formed to have a shape corresponding to a shape of the main fixing piece 226 described above.

While the present invention has been particularly shown and described with reference to exemplary embodiments thereof, it is to be understood that the invention is not limited to the coaxial cable connector according to the invention, and it will be apparent to those skilled in the art that variations and modifications may be made without departing from the scope of the present invention.

It will be understood by those skilled in the art that various changes in form and details may be made therein without departing from the spirit and scope of the invention as defined by the attached claims.

The invention claimed is:

1. A coaxial cable connector, comprising:

a signal pin;

a dielectric to which the signal pin is coupled;

a first body coupled to a connector electrically connected to one side of the signal pin; and a second body formed to extend from the first body and coupled to a cable electrically connected to another side of the signal pin, wherein the first body includes a first body portion formed in a ring shape of which a side is open, and a first extension portion formed to extend from another side of the first body portion, wherein the second body includes a second body portion corresponding to the first body portion and a second extension portion formed to extend from a side of the second body portion and corresponding to the first extension portion, wherein the dielectric includes a third body portion formed to correspond to the first body portion and the second body portion and accommodated in a space formed by the first body portion and the second body portion and a third extension portion formed to correspond to the first extension portion and the second extension portion and formed to extend from the third body portion, wherein the third extension portion includes a connection bracket formed to protrude from an outer circumferential surface of the third body portion, a third bracket formed to extend from the connection bracket and configured to support the other side of the signal pin, and a cover folded toward the other side of the signal pin from the connection bracket and formed to extend to be coupled to the third bracket, wherein the second extension portion includes an extension flat surface portion formed to extend in a lateral direction from the second body portion, a pair of second brackets formed to extend in a vertical direction from two opposite sides of the extension flat surface portion, and a pair of main fixing pieces formed to extend from ends of the pair of second brackets and configured to press the cover, and wherein the first extension portion includes a first bracket formed to extend from the other side of the first body portion and a tongue portion formed to extend from the first bracket and positioned between the cover and the pair of main fixing pieces to press a flat surface of the cover.

2. The coaxial cable connector of claim 1, wherein the tongue portion is positioned at a location where the pair of main fixing pieces are facing each other so that an external signal is blocked.

3. The coaxial cable connector of claim 2, wherein the tongue portion includes a press portion formed in a width direction thereof.

4. The coaxial cable connector of claim 1, wherein the third bracket further includes a pair of vertical guides formed to extend in a vertical direction from two opposite sides of the third bracket so as to guide the cover to be coupled to the third bracket.

5. The coaxial cable connector of claim 1, wherein the fixing portion and the fixed portion are formed in the second extension portion and the third extension portion, respectively.

6. The coaxial cable connector of claim 5, wherein the second extension portion includes an extension flat surface portion formed to extend in a lateral direction from the second body portion and a pair of second brackets formed to extend in a vertical direction from two opposite sides of the extension flat surface portion, the third extension portion includes a connection bracket formed to protrude from an outer circumferential surface of the third body portion and a third bracket formed to extend from the connection bracket and configured to support the other side of the signal pin, and the fixing portion and the fixed portion are formed in the pair of second brackets and the third bracket, respectively.

7. The coaxial cable connector of claim 6, wherein the fixing portion includes a fixing groove, and the fixed portion includes a fixed protrusion.

8. The coaxial cable connector of claim 6, wherein the fixed portion includes a fixed protrusion, and the fixing portion includes a fixing protrusion formed to protrude toward the fixed protrusion.

9. The coaxial cable connector of claim 1, wherein the third extension portion includes a connection bracket formed to protrude from an outer circumferential surface of the third body portion, and the first extension portion includes a first bracket formed to extend from the other side of the first body portion, wherein an insertion protrusion is formed to protrude from the connection bracket, and an insertion hole is formed between the first body portion and the first bracket such that the insertion protrusion is inserted thereinto.

10. The coaxial cable connector of claim 9, wherein one side surface of the insertion protrusion is formed to be inclined.

11. The coaxial cable connector of claim 1, further comprising a guide protrusion formed on an outer circumferential surface of the third body portion, wherein the second body portion includes a flat surface portion, vertical flanges formed to extend in a vertical direction from two opposite sides of the flat surface portion, and a stopper which is bent at one end of the vertical flanges toward an inner side of the flat surface portion such that the guide protrusion is hung thereon.

12. The coaxial cable connector of claim 11, wherein the guide protrusion includes a first guide protrusion configured to restrict the dielectric from moving in one side direction of the second body and a second guide protrusion configured to restrict the dielectric from moving in a width direction of the second body.

13. The coaxial cable connector of claim 12, wherein a guide groove, into which the guide protrusion is inserted, is formed in a lower end of the first body portion.

14. The coaxial cable connector of claim 1, wherein the second body further includes a fixing portion configured to fix the dielectric, and the dielectric further includes a fixed portion corresponding to the fixing portion.

15. A coaxial cable connector, comprising:

a signal pin;

a dielectric to which the signal pin is coupled;

a first body coupled to a connector electrically connected to one side of the signal pin; and a second body formed to extend from the first body and coupled to a cable electrically connected to another side of the signal pin, wherein the first body includes a first body portion formed in a ring shape of which a side is open, wherein the second body includes a second body portion corresponding to the first body portion, wherein the dielectric includes a third body portion formed to correspond to the first body portion and the second body portion and accommodated in a space formed by the first body portion and the second body portion, wherein the coaxial cable connector further comprises a guide protrusion formed on an outer circumferential surface of the third body portion, and wherein the second body portion includes a flat surface portion, vertical flanges formed to extend in a vertical direction from two opposite sides of the flat surface portion, and a stopper which is bent at one end of the vertical flanges toward an inner side of the flat surface portion such that the guide protrusion is hung thereon.

16. The coaxial cable connector of claim 15, wherein the first body further includes a first extension portion formed to extend from another side of the first body portion, the second body further includes a second extension portion formed to extend from a side of the second body portion and corresponding to the first extension portion, and the dielectric further includes a third extension portion formed to correspond to the first extension portion and the second extension portion and formed to extend from the third body portion.

17. The coaxial cable connector of claim 15, wherein the guide protrusion includes a first guide protrusion configured to restrict the dielectric from moving in one side direction of the second body and a second guide protrusion configured to restrict the dielectric from moving in a width direction of the second body.

18. The coaxial cable connector of claim 17, wherein a guide groove, into which the guide protrusion is inserted, is formed in a lower end of the first body portion.

19. The coaxial cable connector of claim 15, wherein the second body includes a fixing portion configured to fix the dielectric, and the dielectric includes a fixed portion corresponding to the fixing portion.

* * * * *